United States Patent [19]

Martin et al.

[11] Patent Number: 5,038,652

[45] Date of Patent: Aug. 13, 1991

[54] KNEE ASSEMBLY FOR A SAWMILL CARRIAGE

[76] Inventors: Virgil L. Martin, 4430 Larkwood St., Eugene, Oreg. 97405; Delbert L. Phelps, 05441 Huckleberry La., Florence, Oreg. 97439

[21] Appl. No.: 460,017

[22] Filed: Jan. 2, 1990

[51] Int. Cl.[5] ..... B27B 29/10

[52] U.S. Cl. ..... 83/726; 83/718; 83/720

[58] Field of Search ..... 83/718, 719, 720, 721, 83/722, 723, 726, 435.1, 730

[56] References Cited

U.S. PATENT DOCUMENTS

| | | | |
|---|---|---|---|
| 384,228 | 6/1888 | Anderson et al. | 83/720 |
| 540,357 | 6/1895 | Hanson | 83/719 |
| 1,804,716 | 5/1931 | Tanner | 83/726 X |
| 2,551,824 | 5/1951 | Coote | 83/721 |
| 3,068,914 | 12/1962 | Sanborn | 83/723 |
| 4,037,502 | 7/1977 | Westfall | 83/726 |
| 4,344,609 | 8/1982 | Bond | 83/726 X |

*Primary Examiner*—Frank T. Yost
*Assistant Examiner*—Eugenia A. Jones
*Attorney, Agent, or Firm*—James D. Givnan, Jr.

[57] ABSTRACT

A sawmill carriage is provided with crosswise disposed guideways along which knee members travel for advancement of a log toward a saw plane. Linear actuators for each knee member are embodied in parallel hydraulic cylinders above and below a slide also on the guideway to reduce overall carriage width. A first linear actuator serves to position the slide while the remaining linear actuator is carried by the slide and has a piston rod end coupled to the knee member. The linear actuators function both in singular and in simultaneous modes to provide desired knee member movement and speed. The linear actuators are of the type providing a feedback signal which is processed by a controller for programmed operation of the actuators. Rail components of the guideways support the knee member and the slide on separate portions of the rails.

12 Claims, 1 Drawing Sheet

KNEE ASSEMBLY FOR A SAWMILL CARRIAGE

BACKGROUND OF THE INVENTION

The present invention pertains generally to sawmill carriages which serve to carry a log into saw engagement with the log being laterally positioned in increments by knees on the carriage.

Currently utilized on sawmill carriages are hydraulic cylinders which serve to position log positioning knees for successive cuts of the log. Such cylinders may be of the type providing a feedback signal to a programmable controller indicating the degree of cylinder piston rod extension to enable precise knee and log positioning. It is highly advantageous to adapt such state-of-the art hydraulic cylinders, commonly termed linear actuators, to existing log carriages however such is often complicated by the obstacle of restricted space as earlier sawmill carriages utilized other powered means such as chain drives for knee positioning. Accordingly, the refurbishing of some existing sawmill carriages with linear actuators of considerable length was not always possible or practical. Without the linear actuators and programmable controllers the competitive status of a sawmill is jeopardized. The physical altering of sawmill premises to provide the additional space is not economically feasible in many instances.

U.S. Pat. No. 4,344,609 discloses a sawmill carriage having a log positioning knee controlled by a hydraulic cylinder with a pneumatic cylinder disposed thereabout for the purpose of absorbing log imparted impact loads against the knee and hydraulic cylinder. U.S. Pat. No. 4,037,502 discloses a sawmill carriage with a log positioning knee controlled by axially aligned cylinders which are extended or retracted in a cumulative manner to provide large and small increments of log positioning. U.S. Pat. No. 1,804,716 discloses a sawmill carriage having knee assemblies each responsive to multiple cylinders with one cylinder being a taper setting cylinder which supplements a primary knee positioning cylinder for the purpose of providing for cutting of a piece of lumber inclined to the major axis of the log.

SUMMARY OF THE PRESENT INVENTION

The present invention is embodied within a compact linear actuator and slide arrangement which permits each carriage knee to be positioned by multiple linear actuators of the type controlled by a computer or controller.

Sawmill carriages characteristically include a frame for reciprocal travel past a saw station with a log on the carriage being incrementally positioned transversely of the carriage to position the log prior to each cut. On the present carriage linear actuators are used in a dual manner with one of the actuators being on a movable platform. The retrofitting of existing sawmill carriages with currently available linear actuators has now been found possible with carriage space limitations overcome by using a slide component interposed between a first and second linear actuator. Carriage knee travel is controlled by actuator movement, either singly or jointly.

Important objectives of the improved carriage include the provision of a knee fully positionable transversely of the carriage utilizing multiple linear actuators and a movable cylinder platform or slide component therebetween; the provision of a carriage with a knee assembly utilizing linear actuators and a movable platform supporting one of the actuators all being of a compact nature suitable for retrofitting existing log carriages without conflict with permanent building walls or other adjacent structures; the provision of compact, dual linear actuators which may be used to retrofit sawmill carriages to benefit from state-of-the art linear actuators and programmable controllers or computers to update sawmill carriages regardless of space limitations in the sawmill.

DETAILED DESCRIPTION OF THE PREFERRED EMBODIMENTS

Figure 1:
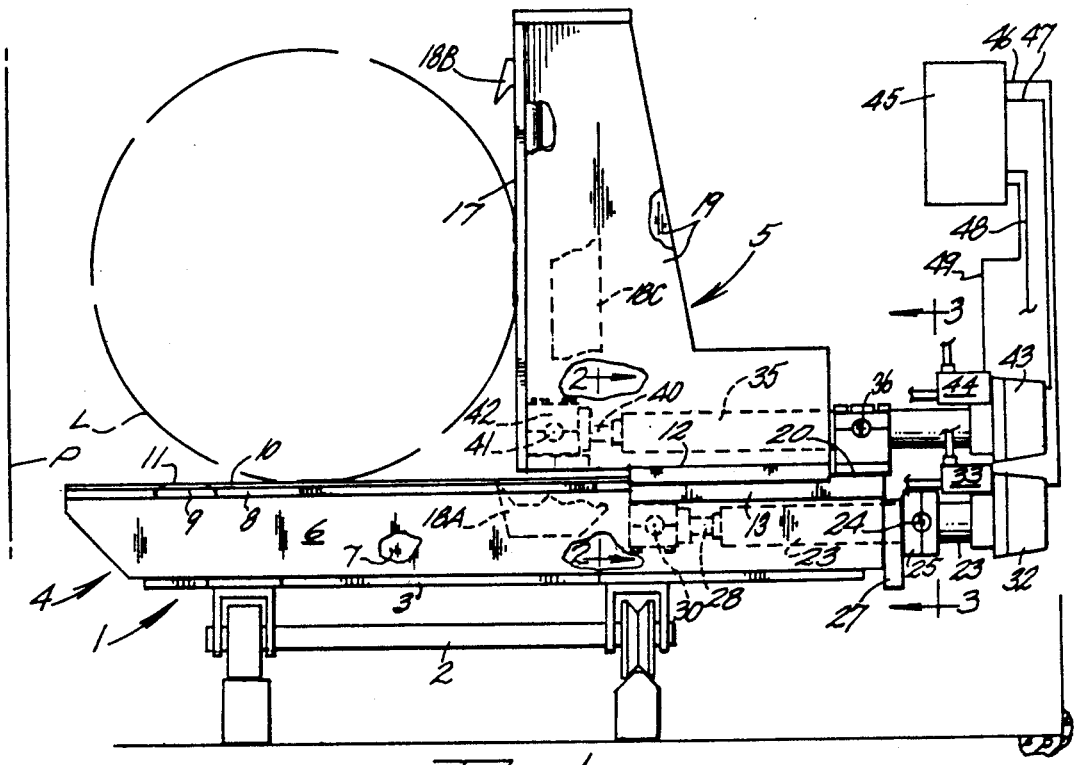
FIG. 1 is an end elevational view of a sawmill carriage with a knee assembly and embodying the present invention.
Figure 2:
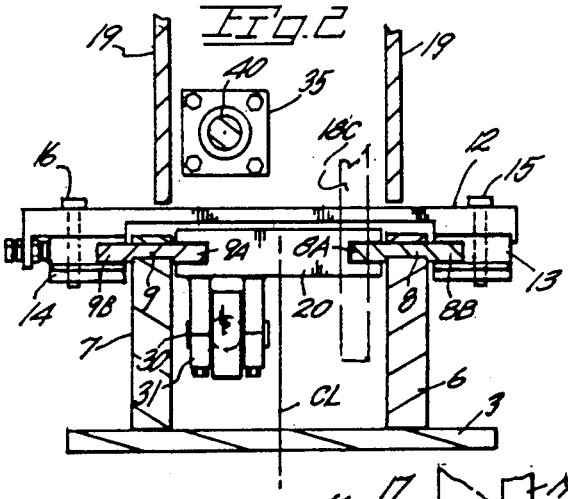
FIG. 2 is a vertical sectional view taken along line 2—2 of FIG. 1.
Figure 3:
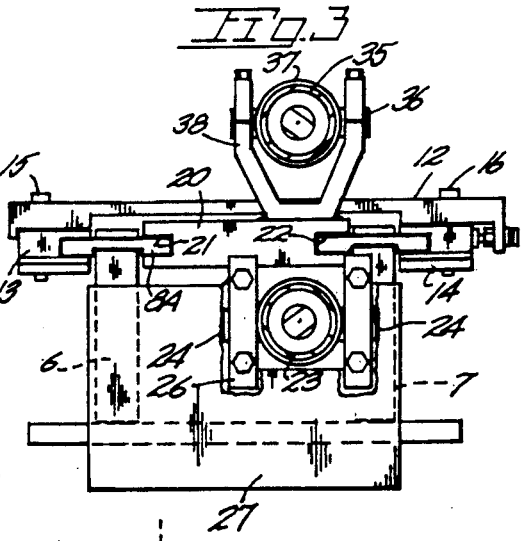
FIG. 3 is a vertical sectional view taken along line 3—3 of FIG. 1.
Figure 4:
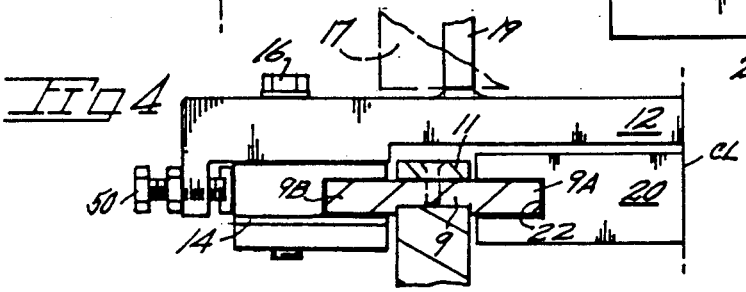
FIG. 4 is an enlarged fragmentary view of the guideway and components supported thereby.

With continuing attention to the drawings wherein applied reference numerals indicate parts similarly hereinafter identified, the reference numeral 1 indicates generally an elongate carriage equipped at intervals with an undercarriage as at 2. The carriage is movable in a reciprocal manner by means not shown for the repeated presentation of a log at L to a saw located in a plane indicated at P. A carriage frame is at 3. Secured at intervals across the elongate carriage frame are guideways generally at 4 which serve to support the log L. Indicated generally at 5 is a knee member which may be considered typical of the remaining knee assemblies spaced at intervals along carriage 1 for the simultaneous advancement of log L toward the saw plane P. The foregoing is intended to be a more or less very general description of a log carriage used for the incremental, lateral advancing of a log toward a saw, and then the advancement of the log past the saw for the cut.

With attention again to guideway 4, which is typical of the remaining guideways, parallel supports at 6 and 7 are suitably affixed in an upright manner to carriage frame 3. Each of said supports is provided with a rail at 8 and 9 each having an inner portion 8A–9A and an outer portion at 8B–9B. The rails 8 and 9 are co-extensive with their supports 6 and 7 and are secured thereon by cap plates 10 and 11 with fasteners extending through the rails and into engagement with supports 6 and 7.

Knee member 5 is entrained on the rails and includes a base plate 12 of a width to overlie and extend outwardly beyond the supports 6 and 7 and their rails. Depending from the opposite sides of knee base plate 12 are elongate shoe assemblies 13 and 14 for travel on the outer rail portions 8B–9B. The shoe assemblies are of friction reducing materials held in place on the underside of plate 12 by rows of fasteners 15 and 16. The knee includes a bar reinforced upright face or frontal plate 17 which engages the log exterior and imparts transverse movement thereto towards the saw plane. Knee member side plates are at 19. The supports 6 and 7 serve as a bunk for log L.

The knee member 5 includes dogs at 18A–18B which engage and retain the log in place against knee frontal plate 17 with a dog arm 18C extending internally of the knee for actuation by an air cylinder (not shown). While the dogs 18A–18B are shown internally mounted within the knee assembly, it will be understood that the dog mechanism may be located externally of the knee structure in which case the later described linear actuators may be located on a knee vertical centerline at CL instead of offset therefrom as shown. The dog components do not constitute part of the present invention.

Knee positioning means includes a carrier, shown in the form of a slide 20, having lengthwise extending channels 21–22 formed along each side to receive the inner portions 8A–9A of the rails. A first linear actuator 23 is located subjacent slide 20 and includes a double acting hydraulic cylinder with a ring and trunnion mount at 24 carried in blocks 25–26 on a mounting bracket 27 secured to the rear ends of supports 6 and 7. The bracket is recessed for cylinder passage. A piston rod 28 of the cylinder actuator terminates in pinned attachment at 30 to a clevis 31 on the underside of slide 20 at the slide forward end. Extension and retraction of piston rod 28 moves the slide along rails 8 and 9. It will be understood that a roller arrangement may be used for the knee and slide. Linear actuator 23 includes a transducer housed at 32 with the linear actuator being of the type transmitting a signal indicative of extended positions of piston rod 28 in fine increments of thousandths of an inch. A servo valve is indicated at 33. A second linear actuator at 35 is superjacent slide 20 and includes a hydraulic cylinder having a trunnion mount at 36 with a trunnion equipped ring 37 carried by a clevis 38 mounted on the rearward end of slide 20 and moves therewith in response to slide movement imparted by said first linear actuator. A piston rod 40 of the second linear actuator terminates in pinned attachment at 41 to a clevis 42 carried by knee face plate 17. Second linear actuator 35 is also of the type providing a feedback signal indicative of the extended position of piston rod 40 as by the use of a transducer within a cylinder mounted housing at 43. A servo valve is at 44. A controller at 45 is responsive to signals generated by each linear actuator and according to a controller program, initiates signals to the actuator servo valves. The term controller comprehends a programmable computer. The linear actuators are controlled to provide simultaneous travel of their piston rods to provide uniform speeds of the carriage knee members. One source of suitable linear actuators are those made and sold by the Aeroquip Corporation of Jackson, Mich.

To assure desired knee member engagement with rail portions 8B–9B, setscrews at 50 may be periodically adjusted to compensate for wear. The rail fasteners 15 and 16 may be also adjusted for the take-up of wear.

Signals from each transducer in housing 32 and 43 are provided to controller 45 via conductors 46 and 47 while controller output signals are applied to the servo valves 33 and 44 via conductors 48 and 49.

While we have shown but a few embodiments of the invention, it will be apparent to those skilled in the art that the invention may be embodied still otherwise without departing from the spirit and scope of the invention.

Having thus described the invention, what is desired to be secured by a Letters Patent is:

1. In a sawmill log carriage having an elongate log carrying frame supported for reciprocal travel past a saw, the improvement comprising guideways transversely disposed at intervals along said frame, knee members each carried by one of said guideways, compact knee positioning means including a slide for travel lengthwise of said guideways, a first linear actuator having one end in fixed relationship with said frame and a remaining end coupled to said slide, a second linear actuator proximate said first linear actuator and having one end in fixed relationship to said slide and having a remaining end coupled to one of said knee members for advancing the knee members and a log on said carriage toward the saw in incremental fashion, said first and second linear actuators oppositely disposed form said slide and each providing feedback signals to a controller with the signals correlated to the degree of extension of the linear actuators, electro-mechanical means associated with said linear actuators and in electrical circuit with said controller.

2. The improvement claimed in claim 1 wherein each of said guideways includes rails, said slide entrained on said rails.

3. The improvement claimed in claim 2 wherein each of said knee members is entrained on said rails.

4. The improvement claimed in claim 3 wherein each of said rails includes inner and outer portions for supporting engagement respectively with said slide and with one of said knee members.

5. The improvement claimed in claim 1 wherein each linear actuators are oppositely disposed above and below said slide.

6. In a sawmill log carriage having an elongate frame supported for reciprocal travel past a saw, the improvement comprising a guideway transversely disposed on the carriage frame, a knee member for travel along the guideway, an actuator carrier movably mounted on said guideway, a first linear actuator having a piston rod coupled to said carrier, a second linear actuator in parallel with said first linear actuator and mounted on said carrier and having a piston rod coupled to said knee member, said first and second linear actuators and said carrier arranged in parallel to one another to minimize the combined length of the actuators permitting use on a carriage in a closely confined area, said actuators providing a feedback signal, a controller for processing the feedback signal from each linear actuator and transmitting signals to each actuator.

7. The improvement claimed in claim 6 wherein said first and second linear actuators are oppositely disposed from said carrier.

8. The improvement claimed in claim 6 wherein said guideway includes rails, said carrier and said knee member movably mounted on said rails.

9. The improvement claimed in claim 8 wherein each of said rails includes portions in separate sliding engagement with said carrier and with said knee member.

10. In an elongate log carriage for a sawmill, the improvement comprising a guideway disposed transversely of the carriage, a knee member entrained on said guideway, an actuator carrier entrained on said guideway, a first linear actuator positioning said carrier, a second linear actuator mounted on said carrier and having a piston rod coupled to said knee member to position the knee member along said guideway, said first and second linear actuators each in juxtaposition with opposite sides of said carrier to minimize the horizontal space occupied by the actuators and said carrier.

11. The improvement claimed in claim 10 wherein said guideway includes a pair of rails, said knee member and said carrier entrained on said pair of rails.

12. The improvement claimed in claim 10 wherein said linear actuators provide a signal indicating the degree of actuator extension, a controller in electrical circuit with said linear actuators and valve means thereon for regulating extension of the linear actuators in a pre-selected manner.

* * * * *